US009921599B2

(12) United States Patent
Katsumata

(10) Patent No.: US 9,921,599 B2
(45) Date of Patent: Mar. 20, 2018

(54) VOLTAGE SWITCHING CIRCUIT AND POWER SUPPLY DEVICE WITH REGULATOR

(71) Applicant: KABUSHIKI KAISHA TOSHIBA, Tokyo (JP)

(72) Inventor: Maomi Katsumata, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/992,707

(22) Filed: Jan. 11, 2016

(65) Prior Publication Data

US 2016/0274615 A1 Sep. 22, 2016

(30) Foreign Application Priority Data

Mar. 16, 2015 (JP) ..... 2015-052560

(51) Int. Cl.
*G05F 1/10* (2006.01)
*G05F 3/26* (2006.01)

(52) U.S. Cl.
CPC ..... *G05F 3/262* (2013.01); *G05F 1/10* (2013.01); *G05F 3/26* (2013.01)

(58) Field of Classification Search
CPC . G05F 1/10; G05F 1/613; G05F 1/618; G05F 3/02; G05F 3/26; G05F 3/262; G05F 5/00; G05F 1/465
See application file for complete search history.

(56) References Cited

U.S. PATENT DOCUMENTS 5,814,972 A * 9/1998 Shimada ..... H02J 9/061 320/132
5,909,142 A * 6/1999 Kawasaki ..... G05F 1/465 327/525

(Continued)

FOREIGN PATENT DOCUMENTS

JP H0919085 A 1/1997
JP H09130996 A 5/1997

(Continued)

OTHER PUBLICATIONS

Japanese Office Action dated Dec. 5, 2017, filed in Japanese counterpart Application No. 2015-052560, 21 pages (with translation).

*Primary Examiner* — Gustavo Rosario Benitez
(74) *Attorney, Agent, or Firm* — Patterson & Sheridan, LLP

(57) ABSTRACT

A voltage switching circuit of an example includes a switching element that switches an electrical connection between a first terminal and a second terminal, a first control circuit that controls the switch element, a regulator circuit that generates a first internal voltage and supply the first control circuit with the first internal voltage, a voltage selection circuit that selects one of a first voltage from the first terminal and a second voltage from the second terminal and supply the regulator circuit with the selected one of the first voltage and the second voltage, a second control circuit that controls the voltage selection circuit, and a voltage generation circuit that generates a second internal voltage using at least one of the first voltage and the second voltage, the second internal voltage is supplied to the voltage selection circuit and the second control circuit.

16 Claims, 11 Drawing Sheets

(56) References Cited

U.S. PATENT DOCUMENTS

| | | | | |
|---|---|---|---|---|
| 6,366,061 | B1 * | 4/2002 | Carley | G05F 3/262 323/223 |
| 2005/0104574 | A1 * | 5/2005 | Hoon | G05F 3/262 323/315 |
| 2008/0309307 | A1 * | 12/2008 | Wang | H02M 1/08 323/311 |
| 2009/0206811 | A1 * | 8/2009 | Easwaran | G05F 1/561 323/282 |
| 2010/0225169 | A1 * | 9/2010 | Hanawa | H03K 17/302 307/43 |
| 2012/0242372 | A1 * | 9/2012 | Kollmann | H03K 17/302 327/77 |
| 2013/0258540 | A1 * | 10/2013 | Katsumata | H02H 9/025 361/101 |
| 2013/0334876 | A1 * | 12/2013 | Yamaguchi | G05F 1/10 307/9.1 |
| 2013/0334877 | A1 * | 12/2013 | Yamaguchi | H02M 3/156 307/9.1 |
| 2015/0005976 | A1 | 1/2015 | Akebono et al. | |
| 2015/0256166 | A1 * | 9/2015 | Saito | H03K 5/1532 327/58 |

FOREIGN PATENT DOCUMENTS

| | | | |
|---|---|---|---|
| JP | 2002111464 | A | 4/2002 |
| JP | 3527971 | B2 | 5/2004 |
| JP | 3852399 | B2 | 11/2006 |
| JP | 2013183562 | A | 9/2013 |

* cited by examiner

2: POWER SUPPLY CIRCUIT

VOLTAGE SWITCHING CIRCUIT AND POWER SUPPLY DEVICE WITH REGULATOR

CROSS-REFERENCE TO RELATED APPLICATION

This application is based upon and claims the benefit of priority from Japanese Patent Application No. 2015-052560, filed Mar. 16, 2015, the entire contents of which are incorporated herein by reference.

FIELD

An embodiment described herein relates generally to a voltage switching circuit and a power supply device.

BACKGROUND

A voltage switching circuit performs switching to connect or disconnect a first terminal and a second terminal with each other, and also selects one of the voltages of the first and second terminals according to the switching. The voltage switching circuit includes a voltage selection circuit and a control circuit, and switches a voltage that is selected by the voltage selection circuit according to logic of a control signal which is output from the control circuit.

However, the control circuit, in general, cannot generate the control signal if a power supply voltage is not provided. Thus, it is necessary to provide a power supply voltage for the control circuit from outside the voltage switching circuit. In this case, the number of input terminals for the voltage switching circuit is increased, and in addition, a circuit that generates the power supply voltage for the control circuit is required in addition to the voltage switching circuit.

DETAILED DESCRIPTION

An example embodiment provides a voltage switching circuit and a power supply device which do not require a dedicated power supply voltage and may perform both switching between the first and second terminals and selection of a voltage of either a first terminal or a second terminal.

In general, according to one embodiment, a voltage switching circuit includes: a switching element that switches an electrical connection between a first terminal and a second terminal, a first control circuit that controls the switch element, a regulator circuit that generates a first internal voltage and supply the first control circuit with the first internal voltage, a voltage selection circuit that selects one of a first voltage from the first terminal and a second voltage from the second terminal and supply the regulator circuit with the selected one of the first voltage and the second voltage, a second control circuit that controls the voltage selection circuit, and a voltage generation circuit that generates a second internal voltage using at least one of the first voltage and the second voltage, the second internal voltage is supplied to the voltage selection circuit and the second control circuit.

Hereinafter, example embodiments will be described with reference to the drawings. The description will be made with a focus on the characteristic configuration and operation of a voltage switching circuit and a power supply device, but configurations and operations which are omitted in the following description may exist in the voltage switching circuit and the power supply device. However, the configurations and operations which are omitted are also included in the scope of the present embodiments.

First Embodiment

Figure 1:
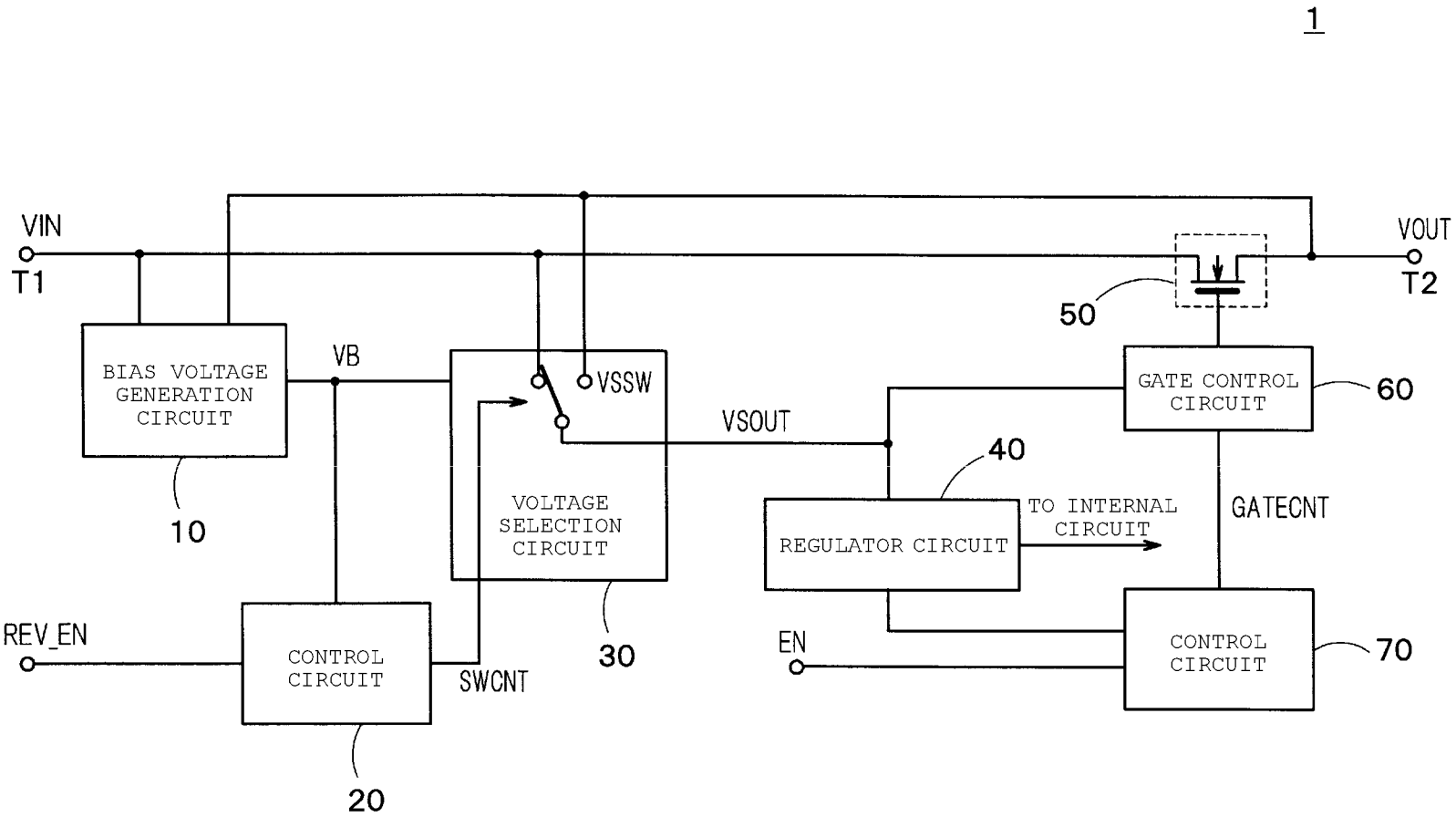
FIG. 1 is a block diagram illustrating a schematic configuration of a voltage switching circuit according to a first embodiment.

FIG. 1 is a block diagram illustrating a schematic configuration of a voltage switching circuit 1 according to a first embodiment. The voltage switching circuit 1 in FIG. 1 includes a first and second terminals T1 and T2, a bias voltage generation circuit (first voltage generation circuit) 10, a control circuit 20, a voltage selection circuit 30, a regulator circuit 40, a switching element 50, a gate control circuit 60, and a control circuit 70.

The first and second terminals T1 and T2 are electrically connected or disconnected by switching (ON or OFF conductive states) of the switching element 50. For example, a DC voltage that is output from a DC voltage generation circuit (which is not specifically illustrated in FIG. 1) is supplied to the first terminal T1. For example, a secondary battery (that is not specifically illustrated in FIG. 1) is connected to the second terminal T2, and the secondary battery may be charged by a voltage VOUT from the second terminal T2. When the first and second terminals T1 and T2 are electrically disconnected with each other, the DC voltage that is otherwise supplied to the secondary battery can be supplied to the regulator circuit 40 from the second terminal T2, whereby an internal power supply voltage may be generated and supplied to an internal circuit.

The bias voltage generation circuit 10 generates a bias voltage (an internal voltage) VB based on at least of one of voltages VIN and VOUT of the first and second terminals T1 and T2. The bias voltage VB is used as a power supply voltage of the voltage selection circuit 30 and the control circuit 20. In this way, the power supply voltage of the voltage selection circuit 30 and the control circuit 20 is not supplied directly from the outside of the voltage switching circuit 1 and is instead internally generated by the voltage switching circuit 1.

The control circuit 20 receives a control signal REV_EN that is input from the outside of the voltage switching circuit 1 and outputs a control signal SWCNT that controls switching of the voltage selection circuit 30.

The voltage selection circuit 30 selects one of the voltage VIN of the first terminal T1 and the voltage VOUT of the second terminal T2 and outputs the selected voltage, based on logic of the first control signal SWCNT. An output voltage VSOUT of the voltage selection circuit 30 is supplied to the regulator circuit 40 and the gate control circuit 60.

The regulator circuit 40 uses the output voltage VSOUT of the voltage selection circuit 30 as a power supply voltage and generates an internal power supply voltage. The internal power supply voltage is supplied to the control circuit 70 and also, is used for an internal circuit that is not specifically illustrated in FIG. 1.

The control circuit 70 uses an internal power supply voltage from the regulator circuit 40 as a power supply voltage, receives a control signal EN that is input from the outside of the voltage switching circuit 1, and generates a control signal GATECNT.

The gate control circuit 60 includes a charge pump circuit and a slew rate control circuit, performs conversion of a voltage level (e.g., voltage level of VSOUT) and waveform adjustment of the control signal GATECNT, and generates a gate voltage of the switching element 50.

The switching element 50 is turned on or off in accordance with a gate voltage from the gate control circuit 60. When the switching element 50 is turned on (conducting), the first and second terminals T1 and T2 are electrically connected with each other, whereby the first and second terminals T1 and T2 become substantially the same voltage.

In an initial state in which a DC voltage generation circuit is connected to the first terminal T1 of the voltage switching circuit 1 and a secondary battery is connected to the second terminal T2, for example, the voltage selection circuit 30 selects the voltage VIN of the first terminal T1. In this state, when, for example, the control signal EN goes to a low signal value, the switching element 50 is turned on, the voltage VIN of the first terminal T1 is supplied to the second terminal T2, and the secondary battery is charged. In this state, the regulator circuit 40 generates the internal power supply voltage using the voltage VIN of the first terminal T1.

Thereafter, when the DC voltage generation circuit is disconnected from the first terminal T1, the logic of the control signal REV_EN is inverted by a command from an internal circuit that is driven by a charged voltage of the secondary battery, for example. As a result, the voltage selection circuit 30 selects the voltage VOUT of the second terminal T2 (that is, the charged voltage of the secondary battery is selected). Thus, in this state, the regulator circuit 40 generates an internal power supply voltage using the voltage VOUT of the second terminal T2. In addition, various electronic apparatuses that can be driven by the charged voltage of the secondary battery may be connected to the first terminal T1.

In this way, when a DC voltage is supplied to the first terminal T1, charging the secondary battery and generating an internal power supply voltage in the regulator circuit 40 are performed with using the voltage VIN of the first terminal T1. When the DC voltage generation circuit is disconnected from the first terminal T1, power is supplied to the various electronic apparatuses that can be connected to the first terminal T1 side from the secondary battery and thus use the voltage VOUT of the second terminal T2 for operation, and the internal power supply voltage from the regulator circuit 40 is generated by using the voltage Vout from the secondary battery connected (or connectable) to second terminal T2. As a result, the internal circuit (for example, IC or the like) that is driven by the internal power supply voltage which is generated by the regulator circuit 40 may also be driven by either of an external power supply voltage and the secondary battery depending upon a state of voltage selection circuit 30.

Figure 2:
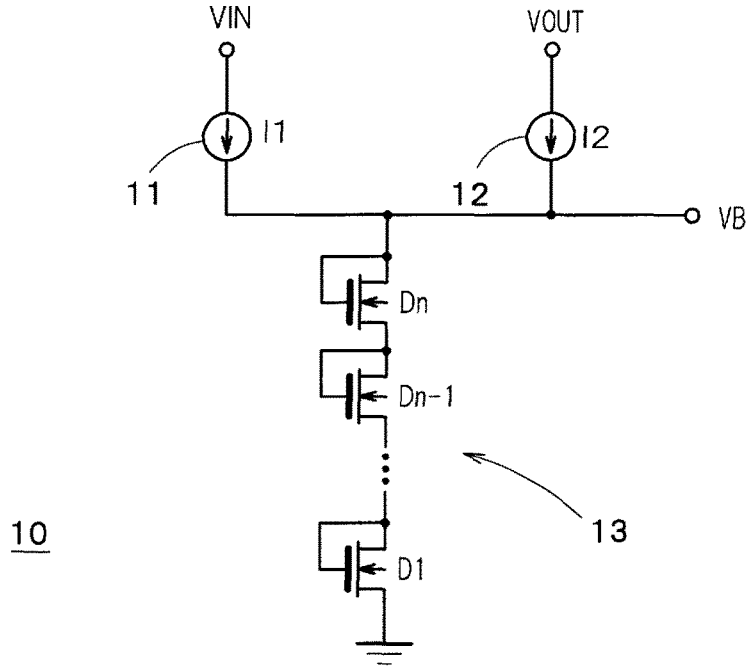
FIG. 2 is a circuit diagram illustrating an example of an internal configuration of a bias voltage generation circuit in FIG. 1.

FIG. 2 is circuit diagram illustrating an example of an internal configuration of the bias voltage generation circuit 10 depicted in FIG. 1. The bias voltage generation circuit 10 depicted in FIG. 2 includes a first current source 11, a second current source 12, and a first rectification circuit 13. The first current source 11 is connected between the first terminal T1 (VIN terminal) and an output node (VB) of the bias voltage generation circuit 10. The second current source 12 is connected between the second terminal T2 (VOUT terminal) and the output node (VB) of the bias voltage generation circuit 10.

The first rectification circuit 13 includes a current path from the output node (VB) of the bias voltage generation circuit 10 to a ground node (reference voltage node), and operates to block a backward current from the ground node to the output node (VB). In the first rectification circuit 13, a plurality of transistors (D1 to Dn) that are each diode-connected is connected in series between the output node (VB) of the bias voltage generation circuit 10 and the ground node. A voltage level of the bias voltage VB may be controlled by the number of stages of the transistors that are connected in series with each other. For example, a gate-source voltage of one stage of one transistor that is diode-connected is substantially 0.6 V to 0.7 V, and thus, when transistors of three stages are connected in series with each other, the bias voltage VB is substantially 1.8 V to 2.1 V.

In general, when n transistors are connected in series with each other and the gate-source voltage of each transistor is referred to as VGS, the bias voltage VB is represented by the following expression (1).

$$VB = n \times VGS \tag{1}$$

A current from at least one of the first current source and the second current source 12 flows through each transistor in the first rectification circuit 13. Thus, when a current that flows through each transistor is referred to as I1, a current amplification rate of each transistor is referred to as $\beta_o$, a gate width of each transistor is referred to as W, a gate length is referred to as L, and a threshold voltage is referred to as Vthn, expression (1) becomes expression (2).

$$VB = n \times VGS = n \times \left\{ \sqrt{\frac{2 \times I_1}{\beta_0 \times \left(\frac{W}{L}\right)}} + V_{thn} \right\} \tag{2}$$

Figure 3:
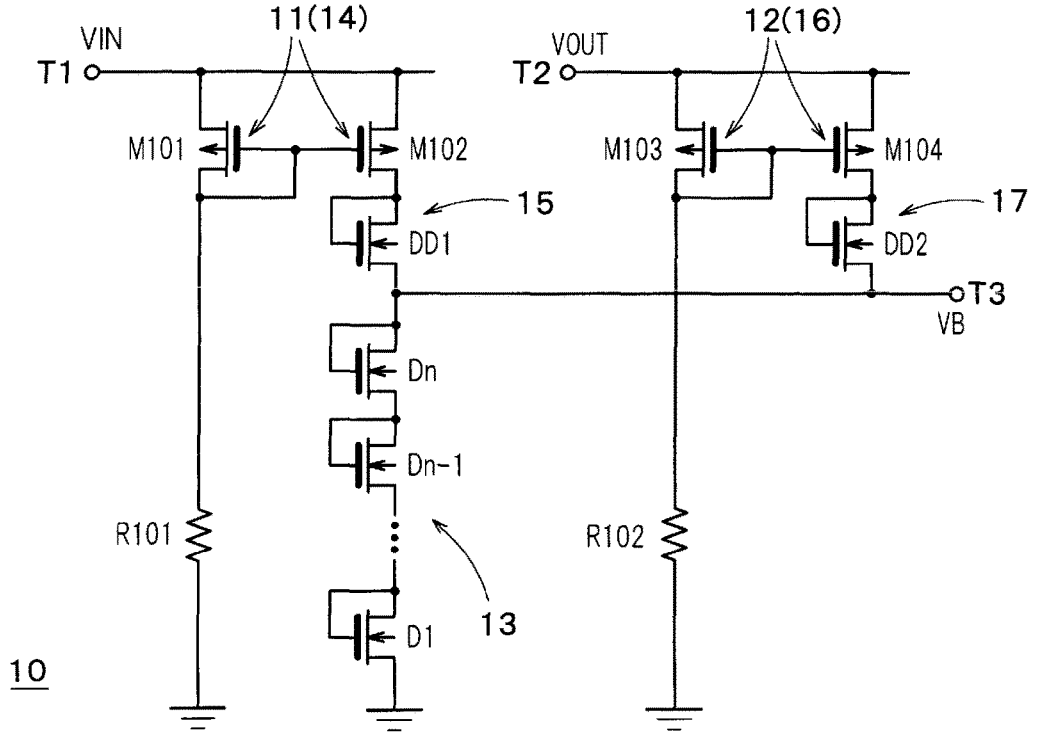
FIG. 3 is a circuit diagram illustrating an example configuration of a first current source and a second current source.

FIG. 3 is a circuit diagram illustrating an example in configuration of the first current source 11 and the second current source 12 depicted in FIG. 2. The first current source 11 depicted in FIG. 3 includes a first current mirror circuit 14 that is connected in series between the first terminal T1 and the output node T3 of the bias voltage generation circuit 10, and a second rectification circuit 15 is connected to the first current mirror circuit 14. The second current source 12 includes a second current mirror circuit 16 that is connected in series between the second terminal T2 and the output node T3 of the bias voltage generation circuit 10, and a third rectification circuit 17 is connected to the second current mirror circuit 16.

The first current mirror circuit 14 includes two PMOS transistors M101 and M102 having sources connected to the first terminal T1 and having gates short-circuited with each other, and a resistor element R101 that is connected between the drain and gate of the transistor M101 and a ground node. The second rectification circuit 15 includes a current path from the first current mirror circuit 14 to an output node of the bias voltage generation circuit 10, and blocks a backward current from the output node to the first current mirror circuit 14. The second rectification circuit 15 includes an NMOS transistor DD1 that is diode-connected. When the voltage VIN of the first terminal T1 is higher than the bias voltage VB, the second rectification circuit 15 makes a current flow into the output node of the bias voltage generation circuit 10 from the first terminal T1, but blocks a backward current. As a result, it is possible to prevent a current from reversely flowing from the output node T3 of the bias voltage generation circuit 10 to the first terminal T1.

The second current mirror circuit 16 includes two PMOS transistors M103 and M104 having sources connected to the second terminal T2 and having gates short-circuited with each other, and a resistor element R102 that is connected between the drain and the gate of the transistor M103 and the ground node.

The third rectification circuit 17 includes a current path from the second current mirror circuit 16 to the output node T3 of the bias voltage generation circuit 10, and blocks a backward current from the output node to the second current mirror circuit 16. The third rectification circuit 17 includes an NMOS transistor DD2 that is diode-connected. When the voltage VOUT of the second terminal T2 is higher than the bias voltage VB, the third rectification circuit 17 makes a current flow into the output node of the bias voltage generation circuit 10 from the second terminal T2, but blocks a backward current. As a result, it is possible to prevent a current from reversely flowing from the output node T3 of the bias voltage generation circuit 10 to the second terminal T2.

A current I1 that is output from the first current source 11 and a current I2 that is output from the second current source 12 are respectively represented by the following expression (3) and expression (4). M of expression (3) is a size ratio of a transistor M102 with respect to a transistor M101, N is a size ratio of a transistor M104 with respect to a transistor M103, VGS_M101 is a gate-source voltage of the transistor M101, and VGS_M103 is a gate-source voltage of the transistor M103.

$$I1=M\times(VIN-VCS_M101)/R101 \quad (3)$$

$$I2=N\times(VIN-VCS_M103)/R102 \quad (4)$$

In this way, in the bias voltage generation circuit 10 in FIG. 3, the diode-connected transistors DD1 and DD2 that are used for preventing a reverse current are connected to the first current source 11 and the second current source 12, and thus, a current does not reversely flow into the first and second terminals T1 and T2 from the output node T3 of the bias voltage generation circuit 10, and it is possible to further stabilize the bias voltage VB. In addition, in the bias voltage generation circuit 10 in FIG. 3, the bias voltage VB may be generated by at least one of the voltages VIN and VOUT of the first and second terminals T1 and T2, and thus, when a voltage is applied to either the first terminal T1 or the second terminal T2, it is possible to generate a normal bias voltage VB.

Figure 4:
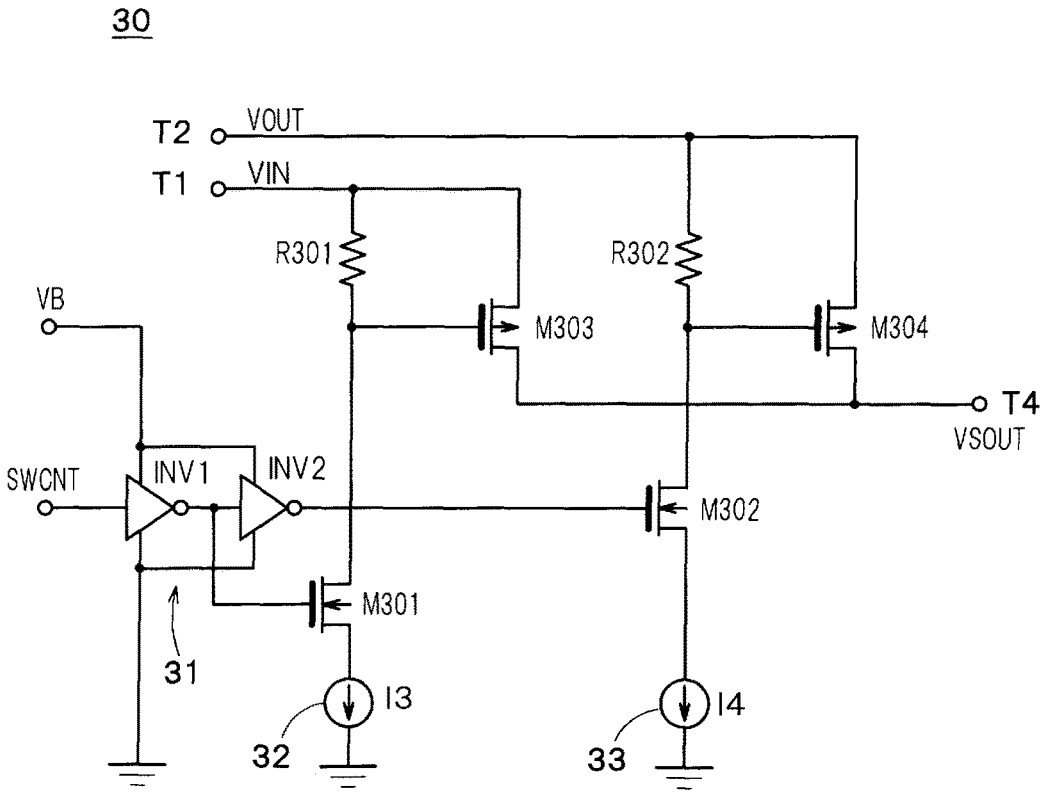
FIG. 4 is a circuit diagram illustrating a first example of a voltage selection circuit.

FIG. 4 is a circuit diagram illustrating a first example of the voltage selection circuit 30 in FIG. 1. The voltage selection circuit 30 depicted in FIG. 4 includes first to fourth transistors M303, M304, M301, and M302, a control circuit (second control circuit) 31, and a third and fourth current sources 32 and 33.

The first transistor M303 switches whether to electrically connect or to electrically disconnect the first terminal T1 and an output node T4 of the voltage selection circuit 30 to or from each other. The first transistor M303 is, for example, a PMOS transistor, a resistor element R301 is connected between the gate of the first transistor and the first terminal T1, the source of the first transistor is connected to the first terminal T1, and the drain of the first transistor is connected to the output node T4 of the voltage selection circuit 30.

The second transistor M304 switches whether to electrically connect or to electrically disconnect the second terminal T2 and the output node T4 of the voltage selection circuit 30 to or from each other. The second transistor M304 is, for example, a PMOS transistor, a resistor element R302 is connected between the gate of the second transistor and the second terminal T2, the source of the second transistor is connected to the second terminal T2, and the drain of the second transistor is connected to the output node T4 of the voltage selection circuit 30. The second transistor M304 electrically connects the second terminal T2 and the output node T4 of the voltage selection circuit 30 when turned on, and electrically disconnects the second terminal T2 and the output node T4 of the voltage selection circuit 30 when turned off (in a non-conducting state).

The third transistor M301 controls ON or OFF of the first transistor M303. The third transistor M301 is, for example, an NMOS transistor. The gate of the third transistor M301 is connected to a first output node of the control circuit 31, the drain thereof is connected to the gate of the first transistor M303, and the source thereof is connected to a third current source.

The fourth transistor M302 controls ON or OFF of the second transistor M304. The fourth transistor M302 is, for example, an NMOS transistor. The gate of the fourth transistor M302 is connected to a second output node of the control circuit 31, the drain thereof is connected to the gate of the second transistor M304, and the source thereof is connected to a fourth current source.

The control circuit 31 includes a plurality (for example, two) of inverters (e.g., INV1 and INV2) that are connected in series with each other. Each of INV1 and INV2 may include a plurality of inverters. As depicted, the inverter INV1 receives an output signal SWCNT of a control circuit 20, and outputs a signal that is obtained by inverting the logic of the output signal SWCNT to a first output node. The inverter INV2 outputs a signal with the same logic as the output signal SWCNT from the control circuit 20 to a second output node. The control circuit 31 uses the bias voltage VB that is generated by the bias voltage generation circuit 10 as a power supply voltage. That is, each inverter INV1 and INV2 of the control circuit 31 performs an inversion operation of an input signal using the bias voltage VB as a power supply voltage.

In the voltage selection circuit 30 depicted in FIG. 4, when the output signal SWCNT of the control circuit 20 is low logic level (L), the third transistor M301 is turned on. As a result, the drain voltage of the third transistor M301, that is, the gate voltage of the first transistor M303 is decreased, the first transistor M303 is turned on, and the voltage VIN of the first terminal T1 is output from the voltage selection circuit 30. In contrast to this, when the output signal SWCNT of the control circuit 20 is high logic level (H), the fourth transistor M302 is turned on. As a result, the drain voltage of the fourth transistor M302, that is, the gate voltage of the second transistor M304 is decreased, the second transistor M304 is turned on, and the voltage VOUT of the second terminal T2 is output from the voltage selection circuit 30.

In this way, the voltage selection circuit 30 in FIG. 4 uses the bias voltage VB as a power supply voltage, and performs switching between the voltage VIN of the first terminal T1 and the voltage VOUT of the second terminal T2 according to the output signal SWCNT. In addition, the bias voltage generation circuit 10 generates the bias voltage VB using at least one of the voltages VIN and VOUT of the first and second terminals T1 and T2. Thus, the voltage selection circuit 30 does need not receive a power supply voltage from outside of the voltage switching circuit 1. Accordingly, it is possible to reduce the number of input terminals of the voltage switching circuit 1, and it is not necessary to separately provide a circuit that generates a power supply voltage outside of the voltage switching circuit 1.

Figure 5:
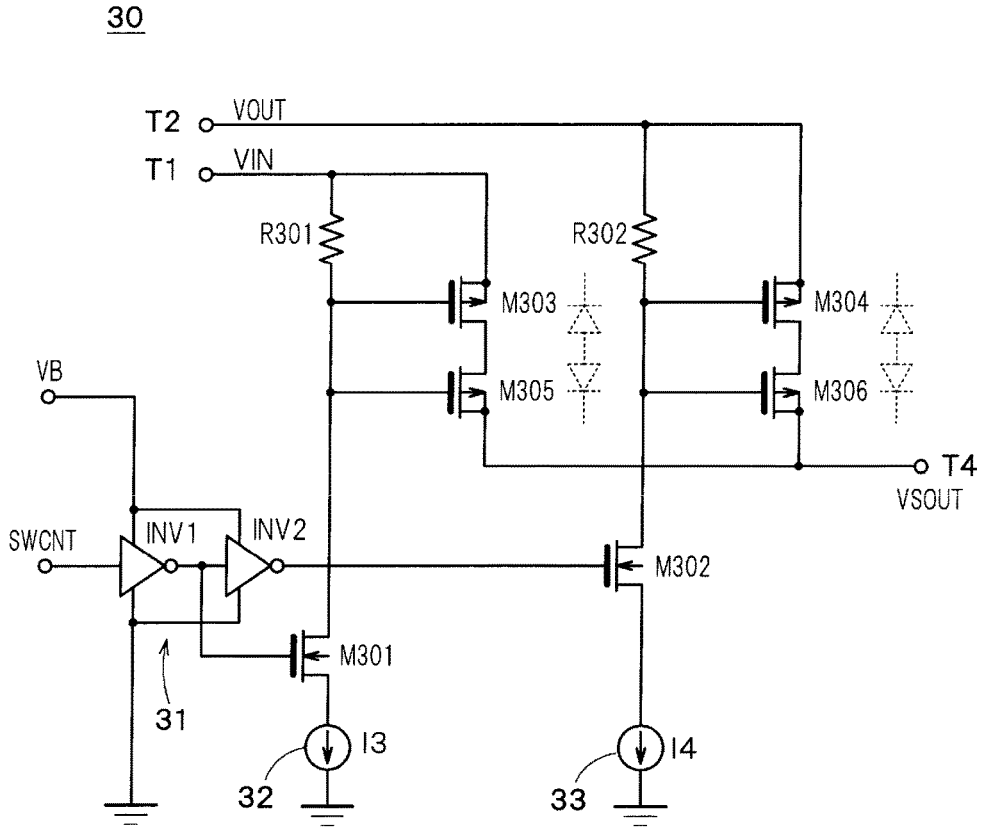
FIG. 5 is a circuit diagram illustrating a second example of a voltage selection circuit.

FIG. 5 is a circuit diagram of a second example of the voltage selection circuit 30 depicted in FIG. 1. The voltage selection circuit 30 depicted in FIG. 5 includes a fifth transistor M305 and a sixth transistor M306, in addition to the circuit configuration of the voltage selection circuit 30 depicted in FIG. 4.

The fifth transistor M305 is connected in series to the first transistor M303 between the first terminal T1 and the output node T4 of the voltage selection circuit 30. The fifth transistor M305 is, for example, a PMOS transistor. The gate of the fifth transistor M305 is connected to the gate of the first transistor M303, the drain of the fifth transistor M305 is connected to the drain of the first transistor M303, and the source of the fifth transistor M305 is connected to the output node T4 of the voltage selection circuit 30. The source of the fifth transistor M305 is connected to the back gate of the fifth transistor, and the source of the first transistor M303 is also connected to the back gate of the first transistor. As a result, as illustrated by a dotted lines in FIG. 5, an equivalent circuit in which two parasitic diodes are connected in a direction opposite to each other (e.g., anode to anode) is formed between the first terminal T1 and the output node T4 of the voltage selection circuit 30.

In the same manner, the sixth transistor M306 is connected in series to the second transistor M304 between the second terminal T2 and the output node T4 of the voltage selection circuit 30. The sixth transistor M306 is, for example, a PMOS transistor. The gate of the sixth transistor M306 is connected to the gate of the second transistor M304, the drain of the sixth transistor M306 is connected to the drain of the second transistor M304, and the source of the sixth transistor M306 is connected to the output node T4 of the voltage selection circuit 30. The source of the sixth transistor M306 is connected to the back gate of the sixth transistor, and the source of the second transistor M304 is also connected to the back gate of the second transistor. As a result, as denoted by a dotted lines in FIG. 5, an equivalent circuit in which two parasitic diodes are connected in a direction opposite with each other (e.g., anode to anode) is formed between the second terminal T2 and the output node T4 of the voltage selection circuit 30. In FIG. 5, the respective drains of the first and fifth transistors M303 and M305 are connected with each other, and the respective drains of the second and sixth transistors M304 and M306 are connected with each other. However, the respective sources may be connected with each other.

In the voltage selection circuit 30 depicted in FIG. 5, when the output signal SWCNT of the control circuit 20 is low (L), the third transistor M301 is turned on. As a result, the drain voltage of the third transistor M301, that is, the gate voltages of the first and fifth transistors M303 and M305 are decreased, the first and fifth transistors M303 and M305 are turned on, and the voltage VIN of the first terminal T1 is output from the voltage selection circuit 30. AT this time, the fourth transistor M302 is turned off, and thus the second transistor M304 and the sixth transistor M306 are also turned off. For this reason, as illustrated by a dotted line in FIG. 5, two parasitic diodes are, in effect, connected in a direction opposite with each other between the second terminal T2 and the output node T4 of the voltage selection circuit 30, whereby a current path between the second terminal T2 and the voltage selection circuit 30 is reliably cut off. Thus, a current does not flow back from the output node T4 of the voltage selection circuit 30 to the second terminal T2.

In contrast to this, when the output signal SWCNT of the control circuit 20 is high (H), the fourth transistor M302 is turned on. As a result, the drain voltage of the fourth transistor M302, that is, the gate voltages of the second and sixth transistors M304 and M306 are decreased, the second and sixth transistors M304 and M306 are turned on, and the voltage VOUT of the second terminal T2 is output from the voltage selection circuit 30. At this time, the third transistor M301 is turned off, and thus the first transistor M303 and the fifth transistor M305 are also turned off. For this reason, as illustrated by a dotted line in FIG. 5, two parasitic diodes are, in effect, connected in a direction opposite with each other between the first terminal T1 and the output node T4 of the voltage selection circuit 30, whereby a current path between the first terminal T1 and the voltage selection circuit 30 is reliably cut off. Thus, a current does not flow back from the voltage selection circuit 30 to the first terminal T1.

In this way, the fifth transistor M305 and the sixth transistor M306 are provided in the voltage selection circuit 30 in FIG. 5, and thus it is possible to prevent a current from flowing back from the output node T4 of the voltage selection circuit 30 to either the first terminal T1 or the second terminal T2.

Figure 6:
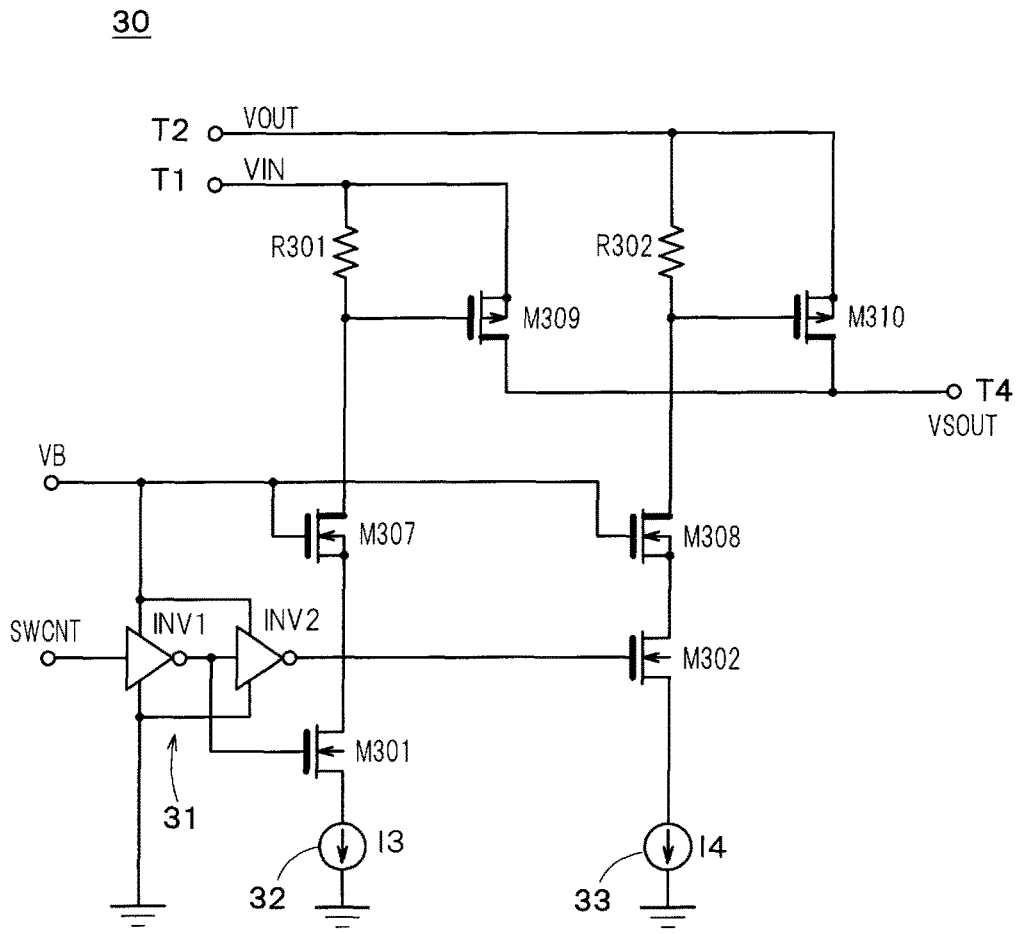
FIG. 6 is a circuit diagram illustrating a third example of a voltage selection circuit.

FIG. 6 is a circuit diagram illustrating a third example of the voltage selection circuit 30. The voltage selection circuit 30 depicted in FIG. 6 is for a case in which the voltages VIN and VOUT of the first and second terminals T1 and T2 are high voltages. The voltage selection circuit 30 depicted in FIG. 6 includes a seventh transistor M307 and an eighth transistor M308, in addition to the circuit configuration depicted in FIG. 4.

The seventh transistor M307 is connected in series to the third transistor M301. The seventh transistor M307 is turned on or off in accordance with the bias voltage VB that is generated by the bias voltage generation circuit 10. The seventh transistor M307 is, for example, an NMOS transistor. The bias voltage VB is supplied to the gate of the seventh transistor M307, the drain of the seventh transistor M307 is connected to the gate of the first transistor M309, and the source of the seventh transistor M307 is connected to the drain of the third transistor M301.

The eighth transistor M308 is connected in series to the fourth transistor M302. The eighth transistor M308 is turned on or off in accordance with the bias voltage VB that is generated by the bias voltage generation circuit 10. The eighth transistor M308 is, for example, an NMOS transistor. The bias voltage VB is supplied to the gate of the eighth transistor M308, the drain of the eighth transistor M308 is connected to the gate of the second transistor M310, and the source of the eighth transistor M308 is connected to the drain of the fourth transistor M302.

The source of the first transistor M309 in FIG. 6 is connected to the back gate of the first transistor, and the source of the second transistor M310 is also connected to the back gate of the second transistor. The first and second transistors M309 and M310 have a high breakdown voltage structure, so as not to be broken down even when high voltages are applied between the respective drains and the respective sources of the first and second transistors.

In the same manner, the source of the seventh transistor M307 is connected to the back gate of the seventh transistor, and the source of the eighth transistor M308 is also connected to the back gate of the eighth transistor. The seventh and eighth transistors M307 and M308 have a high breakdown voltage structure, so as not to be broken down even when high voltages are applied between the respective drains and the respective sources of the seventh and eighth transistors.

In this way, in the voltage selection circuit 30 depicted in FIG. 6, the seventh and eighth transistors M307 and M308 which have a high breakdown voltage structure are connected to the third and fourth transistors M301 and M302, and the drain-source voltages of the third and fourth transistors M301 and M302 are fixed, in such a manner that, even when the levels of the voltages VIN and VOUT of the first and second terminals T1 and T2 become high, voltages equal to or higher than a breakdown voltage are not applied between the respective drains and the respective sources of the third and fourth transistors M301 and M302.

More specifically, the drain-source voltages of the seventh and eighth transistors M307 and M308 may be arbitrarily adjusted in accordance with the bias voltage VB. Thus, the bias voltage VB can be optimized in accordance with the voltages VIN and VOUT of the first and second terminals T1 and T2, and thus, it is possible to control in such a manner that the drain-source voltages of the third and fourth transistors M301 and M302 do not go beyond a breakdown voltage.

In addition, the first and second transistors M309 and M310 have a high breakdown voltage structure, in such a manner that, even when high voltages are applied between the first and second terminals T1 and T2 and the voltage selection circuit 30, the first and second transistors M309 and M310 are not subjected to a breakdown voltage. As a result, the voltage selection circuit 30 depicted in FIG. 6 may perform stably and reliably switching of a high voltage.

Figure 7:
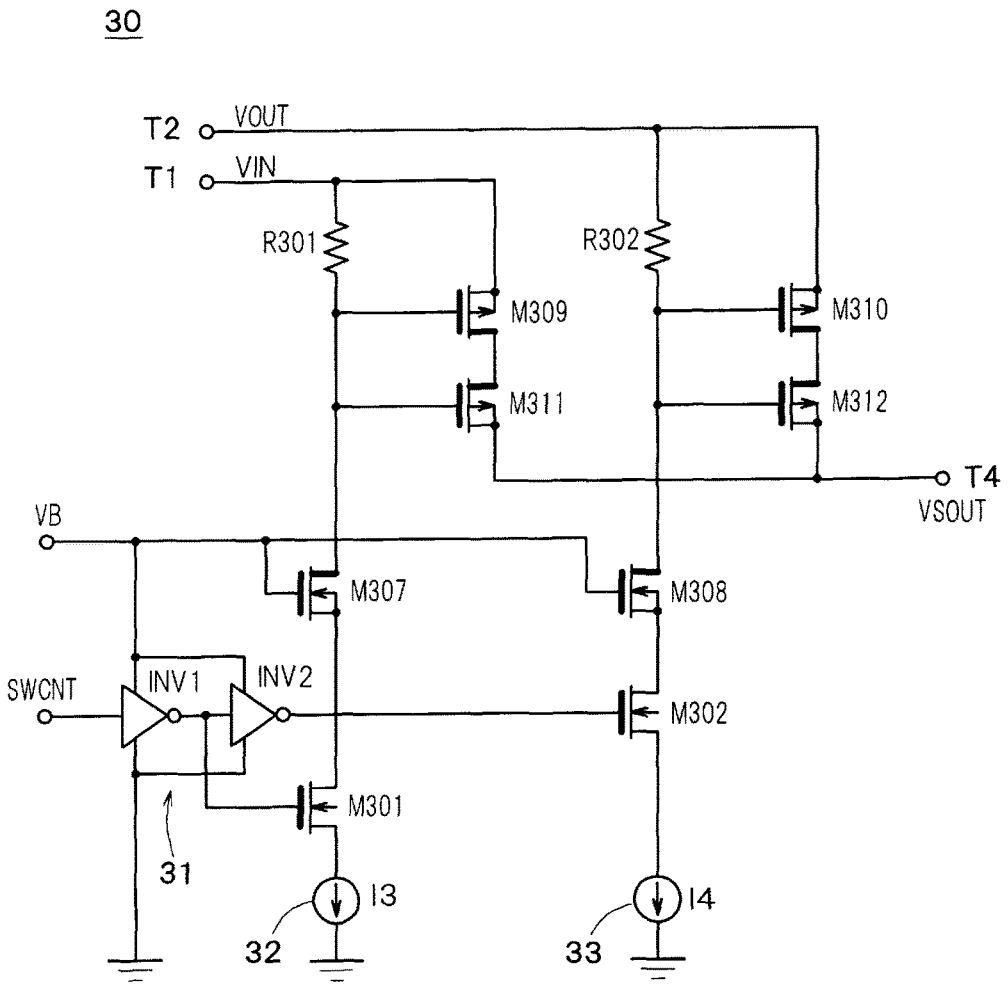
FIG. 7 is a circuit diagram illustrating a fourth example of a voltage selection circuit.

FIG. 7 is a circuit diagram of a fourth example of the voltage selection circuit 30. The fifth and sixth transistors M311 and M312 depicted in FIG. 5 are included in the voltage selection circuit 30 depicted in FIG. 7. In FIG. 7, the fifth and sixth transistors M311 and M312 are added to the circuit configuration of the voltage selection circuit 30 in depicted FIG. 6. However, the fifth and sixth transistors M311 and M312 included in the voltage selection circuit 30 depicted in FIG. 7 have a high breakdown voltage structure.

There is a possibility that high voltages could be applied to the first and second terminals T1 and T2 in FIG. 7, and thus the fifth and sixth transistors M311 and M312 in FIG. 7 have a high breakdown voltage structure. In addition, in a similar manner as in FIG. 5, the first transistor M309 has a source and a back gate which are connected with each other, the fifth transistor M311 has a source and a back gate which are connected with each other, whereby a circuit in which parasitic diodes are connected in a direction opposite with each other is configured, and it is possible to prevent a current from flowing back.

Figure 8:
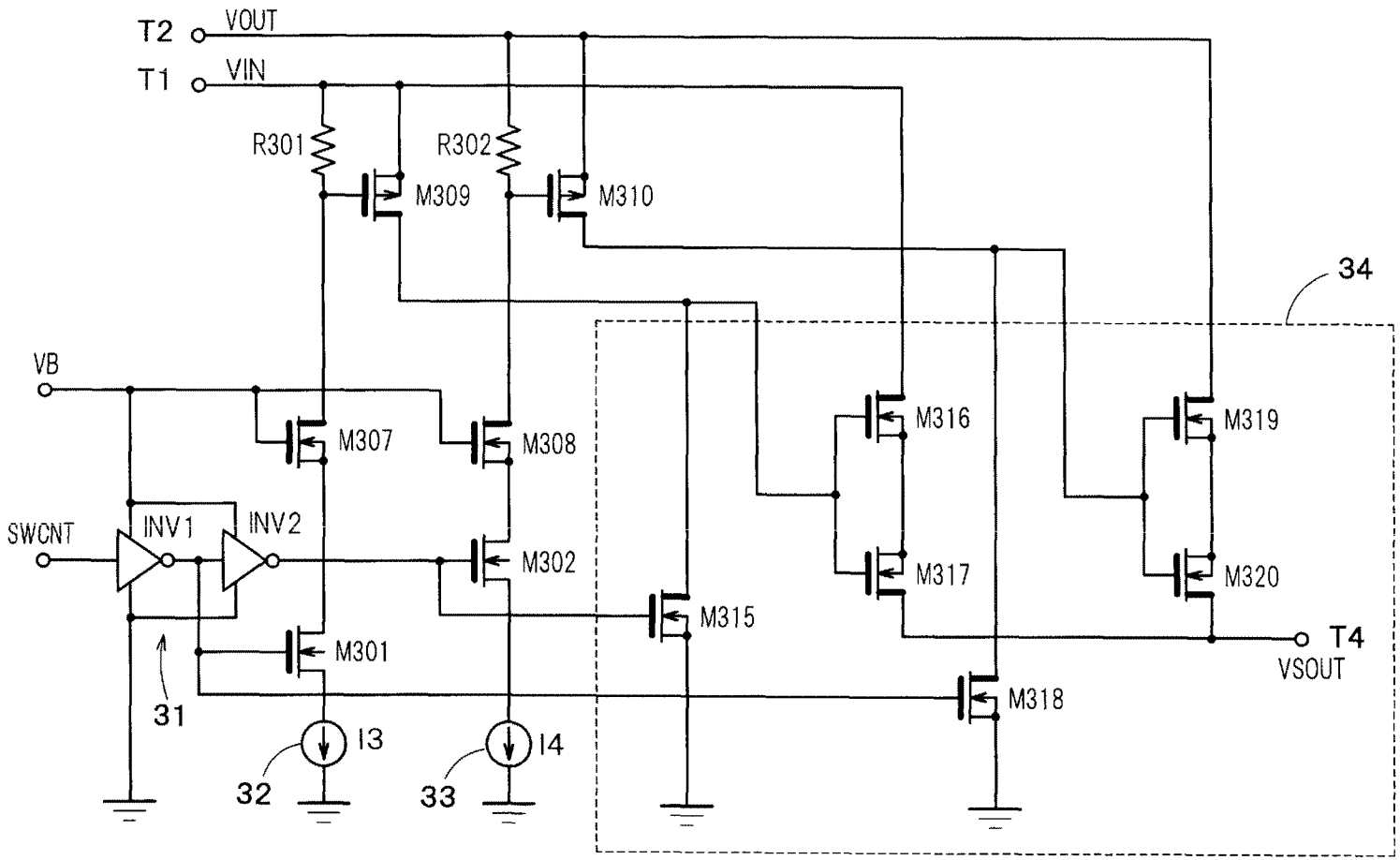
FIG. 8 is a circuit diagram illustrating a fifth example of a voltage selection circuit.

FIG. 8 is a circuit diagram illustrating a fifth example of the voltage selection circuit 30. The voltage selection circuit 30 depicted in FIG. 8 includes a diode OR circuit 34 that is connected to a rear stage of the voltage selection circuit 30 depicted in FIG. 6.

The diode OR circuit 34 depicted in FIG. 8 includes ninth to fourteenth transistors M315 to M320 each having a high breakdown voltage structure.

The ninth and tenth transistors M316 and M317 are connected in series with each other between the first terminal T1 and the output node T4 of the voltage selection circuit 30. The ninth and tenth transistors M316 and M317 are, for example, NMOS transistors. The source of the ninth transistor M316 is connected to the back gate of the ninth transistor M316, and the source of the tenth transistor M317 is connected to the back gate of the tenth transistor M317. The gates of the ninth and tenth transistors M316 and M317 are connected to the drain of the first transistor M309, the drain of the ninth transistor M316 is connected to the first terminal T1, the source of the ninth transistor M316 is connected to the source of the tenth transistor, and the drain of the tenth transistor M317 is connected to the output node T4 of the voltage selection circuit 30.

The eleventh and twelfth transistors M319 and M320 are connected in series with each other between the second terminal T2 and the output node T4 of the voltage selection circuit 30. The eleventh and twelfth transistors M319 and M320 are, for example, NMOS transistors. The source of the eleventh transistor M319 is connected to the back gate of the eleventh transistor, and the source of the twelfth transistor M320 is connected to the back gate of the twelfth transistor. The gates of the eleventh and twelfth transistors M319 and M320 are connected to the drain of the second transistor M310, the drain of the eleventh transistor M319 is connected to the second terminal T2, the source of the eleventh transistor M319 is connected to the source of the twelfth transistor M320, and the drain of the twelfth transistor M320 is connected to the output node T4 of the voltage selection circuit 30.

The sources of the thirteenth transistor M315 and the fourteenth transistor M318 are connected to respective the back gates of the thirteenth and fourteenth transistors (M315 & M318). The gate of the thirteenth transistor M315 is connected to a second output node of the control circuit 31, the drain of the thirteenth transistor M315 is connected to the drain of the first transistor M309, and the source of the thirteenth transistor M315 is grounded. The gate of the fourteenth transistor M318 is connected to the first output node of the control circuit 31, the drain of the fourteenth transistor M318 is connected to the drain of the second transistor M310, and the source of the fourteenth transistor M318 is grounded.

In a case of the voltage selection circuit 30 in FIG. 7, the sources of the fifth and sixth transistors M311 and M312 are connected to the back gates of the fifth and sixth transistors, and thus, it may be that the gate voltages of the fifth and sixth transistors M311 and M312 cannot be increased up to an OFF voltages, there may exist a leakage path through either the fifth transistor M311 or the sixth transistor M312.

Thus, the diode OR circuit 34 is provided in the voltage selection circuit 30 in FIG. 8, whereby the leakage path is removed.

When the output signal SWCNT of the control circuit 20 is low (L), the third transistor M301 is turned on, and the fourth transistor M302 is turned off. As a result, the first transistor M309 is turned on, and the second transistor M310 is turned off. In addition, the thirteenth transistor M315 is turned off, and the fourteenth transistor M318 is turned on. Thus, the ninth and tenth transistors M316 and M317 are turned on, and the eleventh and twelfth transistors M319 and M320 are turned off. As a result, the voltage VIN of the first terminal T1 is transferred to the output node T4 of the voltage selection circuit 30 via the ninth and tenth transistors M316 and M317. In addition, since the fourteenth transistor M318 is turned on, the gate voltages of the eleventh and twelfth transistors M319 and M320 are decreased to a ground potential, the eleventh and twelfth transistors M319 and M320 are reliably turned off, a leakage path from the output node T4 of the voltage selection circuit 30 to the second terminal T2 is completely cut off.

When the output signal SWCNT of the control circuit 20 is high (H), the third transistor M301 is turned off, and the fourth transistor M302 is turned on. As a result, the first transistor M309 is turned off, and the second transistor M310 is turned on. In addition, the thirteenth transistor M315 is turned on, and the fourteenth transistor M318 is turned off. Thus, the ninth and tenth transistors M316 and M317 are turned off, and the eleventh and twelfth transistors M319 and M320 are turned on. As a result, the voltage VOUT of the second terminal T2 is transferred to the output node T4 of the voltage selection circuit 30 via the eleventh and twelfth transistors M319 and M320. In addition, since the thirteenth transistor M315 is turned on, the gate voltages of the ninth and tenth transistors M316 and M317 are decreased to the ground potential, the ninth and tenth transistors M316 and M317 are reliably turned off, a leakage path from the output node T4 of the voltage selection circuit 30 to the first terminal T1 is substantially cut off.

In this way, since the circuit in FIG. 8 provides the diode OR circuit 34 and cuts off a leakage path of a transistor that is turned off, among the first and second transistors M309 and M310, when a connection is not made between the first and second terminals T1 and T2 and the output node T4 of the voltage selection circuit 30, a leakage path is not generated.

Figure 9:
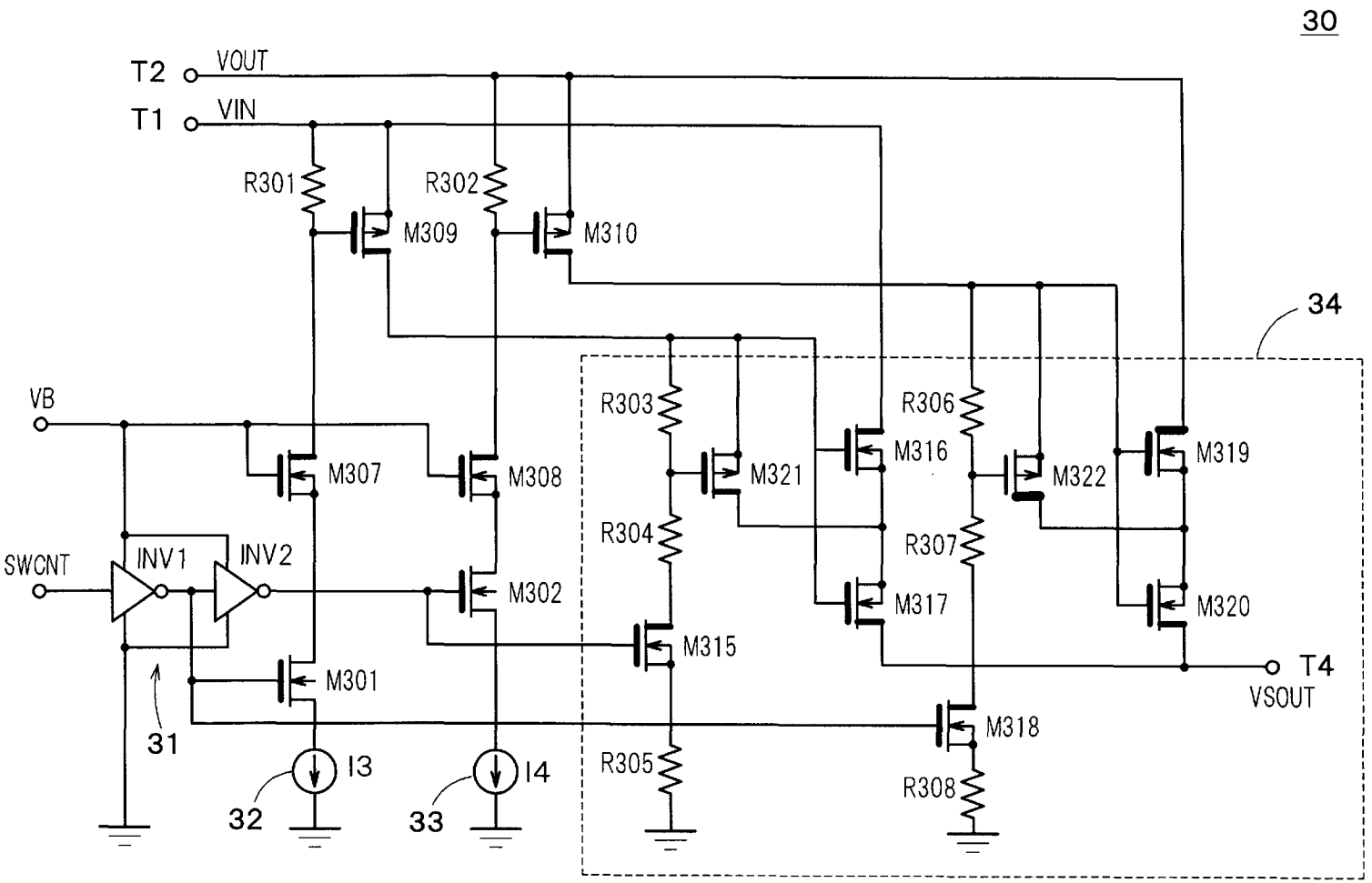
FIG. 9 is a circuit diagram illustrating a sixth example of a voltage selection circuit.

FIG. 9 is a circuit diagram of a sixth example of the voltage selection circuit 30. The voltage selection circuit depicted in FIG. 9 includes fifteenth and sixteenth transistors M321 and M322 that have a high breakdown voltage structure and resistor elements R303 to R308 which have been added to the circuit configuration depicted in FIG. 8.

When the ninth and tenth transistors M316 and M317 are turned off, the fifteenth transistor M321 causes the respective gates and respective sources of the ninth and tenth transistors M316 and M317 to be short-circuited with each other. The fifteenth transistor M321 is, for example, a PMOS transistor. The source and back gate of the fifteenth transistor M321 are connected with each other. Voltages obtained by dividing a drain voltage of the first transistor M309 and the drain voltage of the thirteenth transistor M315 with using a plurality of resistor elements R303 and R304 are supplied to the gate of the fifteenth transistor M321. The source of the fifteenth transistor M321 is connected to the gate of the ninth and tenth transistors M316 and M317. The drain of the fifteenth transistor M321 is connected to the source of the ninth transistor M316 and the source of the tenth transistor M317.

When the eleventh and twelfth transistors M319 and M320 are turned off, the sixteenth transistor M322 causes the respective gates and respective sources of the eleventh and twelfth transistors M319 and M320 to be short-circuited with each other. The sixteenth transistor M322 is, for example, a PMOS transistor. The source and back gate of the sixteenth transistor M322 are connected with each other. Voltages obtained by dividing a drain voltage of the second transistor M310 and the drain voltage of the fourteenth transistor M318 with using a plurality of resistor elements R306 and R307 are supplied to the gate of the sixteenth transistor M322. The source of the sixteenth transistor M322 is connected to the gate of the eleventh and twelfth transistors M319 and M320. The drain of the sixteenth transistor M322 is connected to the source of the eleventh transistor M319 and the source of the twelfth transistor M320.

In the voltage selection circuit 30 depicted in FIG. 9, when the output signal SWCNT of the control circuit 20 is low (L), the thirteenth transistor M315 is turned on. As a result, the fifteenth transistor M321 is also turned on, the gate-source voltages of the ninth and tenth transistors M316 and M317 become the same potential as each other, and the ninth and tenth transistors M316 and M317 are reliably turned off. In the same manner, when the output signal SWCNT of the control circuit 20 is high (H), the fourteenth transistor M318 is turned on. As a result, the sixteenth transistor M322 is also turned on, the gate-source voltages of the eleventh and twelfth transistors M319 and M320 become the same potential as each other, and the eleventh and twelfth transistors M319 and M320 are reliably turned off.

Figure 10:
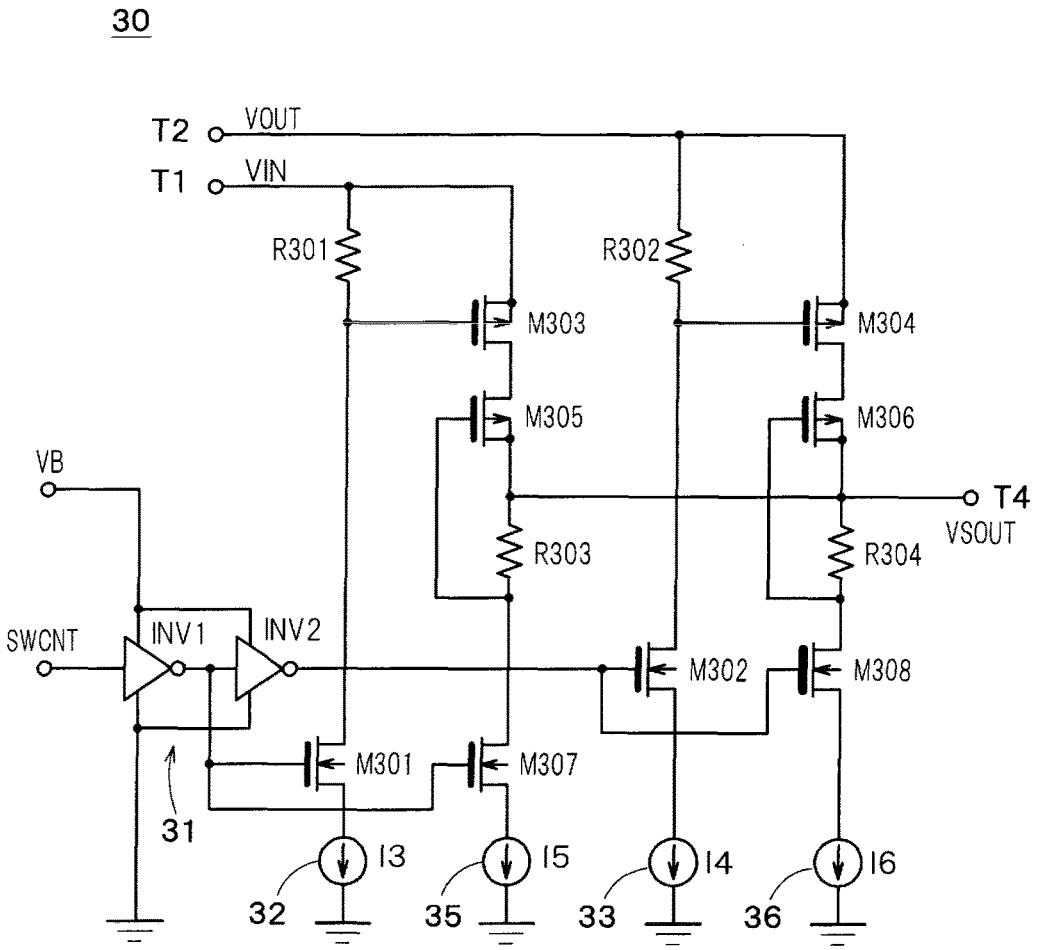
FIG. 10 is a circuit diagram illustrating a seventh example of a voltage selection circuit.

FIG. 10 is a circuit diagram of a seventh example of the voltage selection circuit 30. The voltage selection circuit 30 depicted in FIG. 10 is a circuit having increased backflow prevention characteristics when the first transistor M303 or the second transistor M304 of the voltage selection circuit 30 depicted in FIG. 5 is turned off.

The voltage selection circuit 30 depicted in FIG. 10 includes seventeenth to twentieth transistors M305 to M308, and fifth and sixth current sources 35 and 36 added to the circuit configuration depicted in FIG. 5.

The seventeenth transistor M305 is connected in series to the first transistor M303 between the first terminal T1 and the output node T4 of the voltage selection circuit 30. The seventeenth transistor M305 is, for example, a PMOS transistor, and the source and the back gate thereof are connected with each other. The drain of the seventeenth transistor M305 is connected to the drain of the first transistor M303, and equivalently, these two transistors are configured in such a manner that in effect parasitic diodes are connected in a direction opposite to each other. The gate of the seventeenth transistor M305 is connected to the output node T4 of the voltage selection circuit 30 and the source of the seventeenth transistor M305 via the resistor element R303.

The gate of the eighteenth transistor M307 is connected to the first output node of the control circuit 31, the drain of the eighteenth transistor M307 is connected to the gate of the seventeenth transistor M305, and the source of the eighteenth transistor M307 is connected to a fifth current source 35.

The nineteenth transistor M306 is connected in series to the second transistor M304 between the second terminal T2 and the output node T4 of the voltage selection circuit 30. The nineteenth transistor M306 is, for example, a PMOS transistor, and the source and the back gate thereof are connected with each other. The drain of the nineteenth transistor M306 is connected to the drain of the second transistor M304, and equivalently, these two transistors are configured in such a manner that parasitic diodes are in effect connected in a direction opposite with each other. The gate of the nineteenth transistor M306 is connected to the output node T4 of the voltage selection circuit 30 and the source of the nineteenth transistor M306 via the resistor element R304.

The gate of the twentieth transistor M308 is connected to a second output node of the control circuit 31, the drain of the twentieth transistor M308 is connected to the gate of the nineteenth transistor M306, and the source of the twentieth transistor M308 is connected to a sixth current source 36.

When the output signal SWCNT of the control circuit 20 is low (L), the third transistor M301, the seventeenth transistor M305, and the eighteenth transistor M307 are turned on together, and the fourth transistor M302, the nineteenth transistor M306, and the twentieth transistor M308 are turned off together. Thus, the first transistor M303 is turned on, and the voltage VIN of the first terminal T1 is supplied to the output node T4 of the voltage selection circuit 30. At this time, the second transistor M304 and the twentieth transistor M308 are turned off, whereby the gate and source of the nineteenth transistor M306 become substantially the same potential, and the nineteenth transistor M306 is reliably turned off.

When the output signal SWCNT of the control circuit 20 is high (H), the fourth transistor M302, the nineteenth transistor M306, and the twentieth transistor M308 are turned on together, and the third transistor M301, the seventeenth transistor M305, and the eighteenth transistor M307 are turned off together. Thus, the second transistor M304 is turned on, and the voltage VOUT of the second terminal T2 is supplied to the output node T4 of the voltage selection circuit 30. At this time, the first transistor M303 and the eighteenth transistor M307 are turned off, whereby the gate and source of the seventeenth transistor M305 become substantially the same potential, and the seventeenth transistor M305 is reliably turned off.

Figure 11:
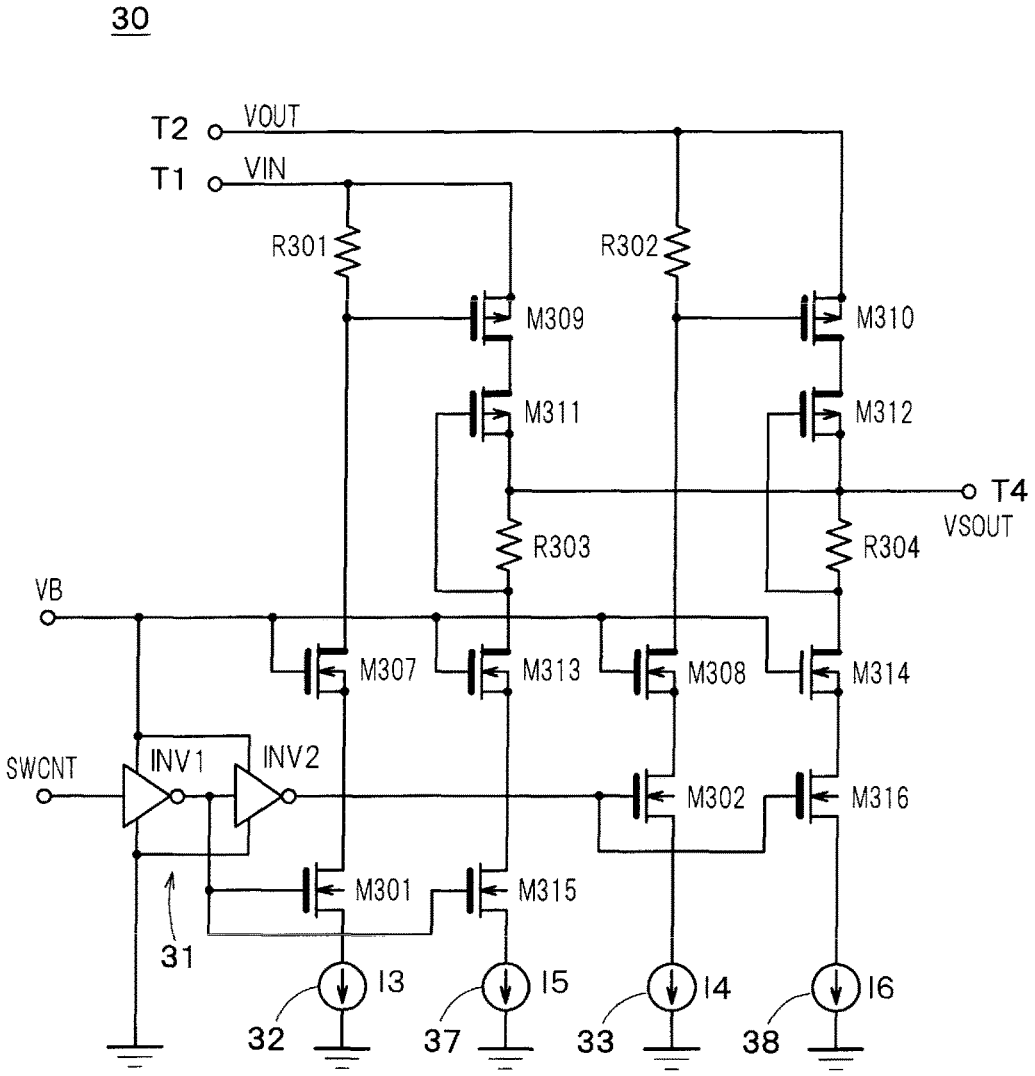
FIG. 11 is a circuit diagram illustrating an eighth example of a voltage selection circuit.

FIG. 11 is a circuit diagram illustrating an eighth example of the voltage selection circuit 30. The voltage selection circuit 30 depicted in FIG. 11 is a circuit which increases backflow prevention characteristics when the first transistor M309 or the second transistor M310 of the voltage selection circuit 30 depicted in FIG. 7 is turned off.

The voltage selection circuit 30 depicted in FIG. 11 includes twenty-first to twenty-sixth transistors M311 to M316, and seventh and eighth current sources 37 and 38, in addition to the circuit configuration depicted in FIG. 7. Among these, the twenty-first, twenty-second, twenty-fourth, and twenty-fifth transistors M311, M313, M312, and M314 have a high breakdown voltage structure.

The twenty-first transistor M311 is connected in series to the first transistor M309 between the first terminal T1 and the output node T4 of the voltage selection circuit 30. The twenty-first transistor M311 is, for example, a PMOS transistor, and the source and the back gate thereof are connected with each other. The drain of the twenty-first transistor M311 is connected to the drain of the first transistor M309, and equivalently, these two transistors are configured in such a manner that parasitic diodes are connected in a direction opposite with each other. The gate of the twenty-first transistor M311 is connected to the output node T4 of the voltage selection circuit 30 and the source of the twenty-first transistor M311 via the resistor element R303.

The bias voltage VB is supplied to the gate of the twenty-second transistor M313. The twenty-second transistor M313 is, for example, an NMOS transistor, and the source and the back gate thereof are connected with each other. The drain of the twenty-second transistor M313 is connected to the gate of the twenty-first transistor M311, and the source of the twenty-second transistor M313 is connected to the drain of the twenty-third transistor M315. The gate of the twenty-third transistor M315 is connected to the first output node of the control circuit 31, and the source of the twenty-third transistor M315 is connected to a seventh current source 37.

The twenty-fourth transistor M312 is connected in series to the second transistor M310 between the second terminal T2 and the output node T4 of the voltage selection circuit 30. The twenty-fourth transistor M312 is, for example, a PMOS transistor, and the source and the back gate thereof are connected with each other. The drain of the twenty-fourth transistor M312 is connected to the drain of the second transistor M310, and equivalently, these two transistors are configured in such a manner that, in effect, parasitic diodes are connected in a direction opposite with each other. The gate of the twenty-fourth transistor M312 is connected to the output node T4 of the voltage selection circuit 30 and the source of the twenty-fourth transistor M312 via the resistor element R304.

The bias voltage VB is supplied to the gate of the twenty-fifth transistor M314. The twenty-fifth transistor M314 is, for example, an NMOS transistor, and the source and the back gate thereof are connected with each other. The drain of the twenty-fifth transistor M314 is connected to the gate of the twenty-fourth transistor M312, and the source of the twenty-fifth transistor M314 is connected to the drain of the twenty-sixth transistor M316. The gate of the twenty-sixth transistor M316 is connected to the first output node of the control circuit 31, and the source of the twenty-sixth transistor M316 is connected to an eighth current source 38.

When the output signal SWCNT of the control circuit 20 is low (L), the third transistor M301 and the twenty-third transistor M315 are turned on, whereby the first transistor M309 and the twenty-first transistor M311 are turned on. In addition, the fourth transistor M302 and the twenty-sixth transistor M316 are turned off, whereby the second transistor M310 and the twenty-fourth transistor M312 are turned off.

As a result, a voltage of the first terminal is transferred to the output node T4 of the voltage selection circuit 30 via the first transistor M309 and the twenty-first transistor M311. At this time, the second transistor M310 and the twenty-sixth transistor M316 are turned off, whereby the gate and the source of the twenty-fourth transistor M312 become substantially the same potential, and the twenty-fourth transistor M312 is reliably turned off.

When the output signal SWCNT of the control circuit 20 is high (H), the fourth transistor M302 and the twenty-sixth transistor M316 are turned on, whereby the second transistor M310 and the twenty-fourth transistor M312 are turned on. In addition, the third transistor M301 and the twenty-third transistor M315 are turned off, whereby the first transistor M309 and the twenty-first transistor M311 are turned off.

As a result, a voltage of the second terminal T2 is transferred to the output node T4 of the voltage selection circuit 30 via the second transistor M310 and the twenty-fourth transistor M312. At this time, the first transistor M309 and the twenty-third transistor M315 are turned off, whereby the gate and the source of the twenty-first transistor M311 become substantially the same potential, and the twenty-first transistor M311 is reliably turned off.

Figure 12:
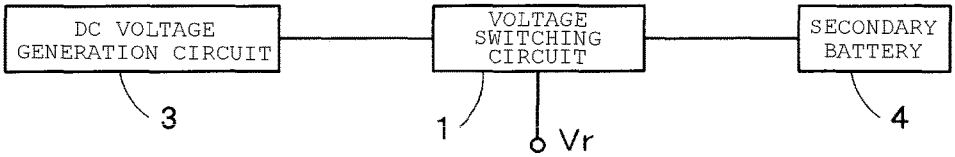
FIG. 12 is a block diagram illustrating a schematic configuration of a power supply device according to an embodiment.

The voltage switching circuits 1 illustrated in FIG. 1 to FIG. 11 and described above may be used as a portion of, for example, a power supply device. FIG. 12 is a block diagram illustrating a schematic configuration of a power supply device 2 according to such an embodiment. The power supply device 2 in FIG. 12 includes a DC voltage generation circuit 3 and the voltage switching circuit 1, and a rechargeable secondary battery 4 that detachably connected to the voltage switching circuit 1.

The DC voltage generation circuit 3 is an AC/DC converter, a DC/DC converter, or the like, and for example, generates a DC voltage with a predetermined voltage level from a commercial power supply.

The voltage switching circuit 1 depicted in FIG. 12 has a circuit configuration corresponding to at least one of FIG. 1 to FIG. 11 described above. The DC voltage generation circuit 3 and the voltage switching circuit 1 are connected with each other by, for example, a cable that may transfer power, such as a universal serial bus (USB). When The DC voltage generation circuit 3 and the secondary battery 4 are connected with each other, the voltage switching circuit 1 receives a DC voltage from the first terminal T1 which is supplied from the DC voltage generation circuit 3, then outputs power from the second terminal T2 via the switching element 50, and thusly performs charging of the secondary battery 4. While the secondary battery 4 is being charged (that is while DC voltage generation circuit 3 is connected to an external power supply), the bias voltage generation circuit 10 generates the bias voltage VB, using a DC voltage that is supplied from the DC voltage generation circuit 3, and an internal voltage Vr is generated by the regulator circuit 40. The internal voltage Vr is used as a power supply voltage of an internal circuit that is not specifically illustrated.

Meanwhile, when the DC voltage generation circuit 3 has been disconnected from the voltage switching circuit 1 (or the external power supply connected thereto has been turned off), the voltage switching circuit 1 generates the bias voltage VB in the bias voltage generation circuit 10, by using a stored charge of the secondary battery 4, and generates the internal voltage Vr in the regulator circuit 40 using the stored charge from the secondary battery 4.

In this way, in according to an embodiment, a power supply voltage that is used within the voltage selection circuit 30 is generated by the bias voltage generation circuit 10 with in the voltage switching circuit 1, and thus it is not necessary to supply a separate power supply voltage from the outside of the voltage switching circuit 1. As a result, a circuit that generates a power supply voltage is not needed outside of the voltage switching circuit 1, and it is consequently possible to reduce the number of input terminals of the voltage switching circuit 1.

In addition, a backflow prevention transistor or the like may be provided in the bias voltage generation circuit 10 that generates the bias voltage VB which is used as the power supply voltage of the voltage selection circuit 30, and thus, it is possible to stabilize a voltage level of the bias voltage VB.

Furthermore, a backflow prevention transistor or the like may be connected between the first and second terminals T1 and T2 and an output node, also in the voltage selection circuit 30, and thus even when a voltage of the output node is higher than those of the first and second terminals T1 and T2, it is possible to reliably prevent a current from flowing back.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A voltage switching circuit, comprising:

a switching element configured to switch an electrical connection between a first terminal and a second terminal;

a first control circuit configured to control the switching element;

a regulator circuit configured to generate a first internal voltage and supply the first control circuit with the first internal voltage;

a voltage selection circuit configured to select one of a first voltage from the first terminal and a second voltage from the second terminal and supply the regulator circuit with the selected one of the first voltage and the second voltage;

a second control circuit configured to control the voltage selection circuit; and a voltage generation circuit configured to generate a second internal voltage using at least one of the first voltage and the second voltage, the second internal voltage supplied to the voltage selection circuit and the second control circuit, the voltage generation circuit comprising:

a first current source connected between the first terminal and a first output node of the voltage generation circuit;

a second current source connected between the second terminal and the first output node; and a first rectification circuit connected between the first output node and a reference voltage node;

a second rectification circuit connected in series with the first current source between the first terminal and the first output node; and a third rectification circuit connected in series with the second current source between the second terminal and the first output node.

2. The voltage switching circuit according to claim 1, the voltage selection circuit comprising:

a first transistor configured to switch a connection between the first terminal and a second output node of the voltage selection circuit;

a second transistor configured to switch a connection between the second terminal and the second output node;

a third transistor configured to control a conductive state of the first transistor; and a fourth transistor configured to control a conductive state of the second transistor, wherein the third and fourth transistors are controlled by a control signal from the second control circuit.

3. The voltage switching circuit according to claim 2, the voltage selection circuit comprising:

a fifth transistor connected in series with the first transistor between the first terminal and the second output node; and a sixth transistor connected in series with the second transistor between the second terminal and the second output node, wherein the first transistor and the fifth transistor are controlled by the third transistor, the second transistor and the sixth transistor are controlled by the fourth transistor, each of the first, second, fifth, and sixth transistors respectively includes a source and a back gate, that are connected to each other, the first transistor and the fifth transistor have a same conductivity type and have one of drains mutually connected to each other or sources mutually connected to each other, and the second transistor and the sixth transistor have a same conductivity type and have one of drains mutually connected to each other or sources mutually connected to each other.

4. The voltage switching circuit according to claim 2, the voltage selection circuit comprising:

a seventh transistor connected in series with the third transistor and configured to control the first transistor in accordance with the second internal voltage and to control a drain-source voltage of the third transistor to be constant; and an eighth transistor connected in series with the fourth transistor and configured to control the second transistor in accordance with the second internal voltage and to control a drain-source voltage of the fourth transistor to be constant.

5. The voltage switching circuit according to claim 2, the voltage selection circuit comprising:

ninth and tenth transistors connected in series between the first terminal and the second output node;

eleventh and twelfth transistors connected in series between the second terminal and the second output node;

a thirteenth transistor configured to control the ninth and tenth transistors in accordance with the control signal; and a fourteenth transistor configured to control the eleventh and twelfth transistors, in accordance with the control signal, wherein each of the ninth, tenth, eleventh, and twelfth transistors respectively includes a source and a back gate that are connected to each other, the ninth and tenth transistors are a same conductivity type and have one of drains mutually connected to each other or sources mutually connected to each other, and the eleventh and twelfth transistors are a same conductivity type and have one of drains mutually connected to each other or sources mutually connected to each other.

6. The voltage switching circuit according to claim 5, the voltage selection circuit comprising:

a fifteenth transistor that, configured to cause a gate and a source of the ninth transistor to be short-circuited with each other while the ninth and tenth transistors are in an OFF conductive state, and to cause a gate and a source of the tenth transistor to be short-circuited with each other while the ninth and tenth transistors are in the OFF conductive state; and a sixteenth transistor configured to cause a gate and a source of the eleventh transistor to be short-circuited with each other while the eleventh and twelfth transistors are in an OFF conductive state, and to cause a gate and a source of the twelfth transistor to be short-circuited with each other cause while the eleventh and twelfth transistors are in the OFF conductive state.

7. The voltage switching circuit according to claim 2, the voltage selection circuit comprising:

a seventeenth transistor connected in series with the first transistor between the first terminal and the second output node;

an eighteenth transistor configured to control the seventeenth transistor in accordance with the control signal;

a nineteenth transistor connected in series with the second transistor between the second terminal and the second output node; and a twentieth transistor configured to control the nineteenth transistor in accordance with the control signal, wherein the eighteenth transistor is configured to turn off the seventeenth transistor while the first transistor is in an OFF conductive state, and the twentieth transistor is configured to turn off the nineteenth transistor while the second transistor is in an OFF conductive state.

8. The voltage switching circuit according to claim 2, the voltage selection circuit comprising:

a twenty-first transistor connected in series with the first transistor between the first terminal and the second output node;

a twenty-second transistor connected in series with the twenty-first transistor and configured to control the first transistor in accordance with a level of the second internal voltage;

a twenty-third transistor connected in series with the twenty-second transistor and configured to control the twenty-first transistor in accordance with the control signal;

a twenty-fourth transistor connected in series with the second transistor between the second terminal and the second output node;

a twenty-fifth transistor connected in series with the twenty-fourth transistor and configured to control the second transistor in accordance with the level of the second internal voltage; and a twenty-sixth transistor connected in series with the twenty-fifth transistor and configured to control the twenty-fourth transistor in accordance with the control signal, wherein the twenty-third transistor is configured to turn off the twenty-first transistor while the first transistor is in an OFF conductive state, and the twenty-sixth transistor is configured to turn off the twenty-fourth transistor while the second transistor is in an OFF conductive state.

9. A power supply device, comprising:

a voltage switching circuit according to the claim 1; and a DC voltage generation circuit configured to provide a DC voltage at the first terminal; wherein the second terminal is connectable to a battery and capable of receiving a battery voltage from the battery.

10. The power supply device according to claim 9, the voltage selection circuit comprising:

a first transistor configured to switch a connection between the first terminal and a second output node of the voltage selection circuit;

a second transistor configured to switch a connection between the second terminal and the second output node;

a third transistor configured to control conductive state of the first transistor; and a fourth transistor configured to control conductive state of the second transistor, wherein the third and fourth transistors are controlled by the control signal from the second control circuit.

11. The power supply device according to claim 10, the voltage selection circuit comprising:

a fifth transistor connected in series with the first transistor between the first terminal and the second output node; and a sixth transistor connected in series with the second transistor between the second terminal and the second output node, wherein the first transistor and the fifth transistor are controlled by the third transistor, the second transistor and the sixth transistor are controlled by the fourth transistor, each of the first, second, fifth, and sixth transistors respectively has a source and a back gate that are connected to each other, the first transistor and the fifth transistor are a same conductivity type and have one of drains mutually connected to each other or sources mutually connected to each other, and the second transistor and the sixth transistor are a same conductivity type and have one of drains mutually connected to each other or sources mutually connected to each other.

12. The power supply device according to claim 10, the voltage selection circuit comprising:

a seventh transistor connected in series with the third transistor and configured to control the first transistor in accordance with the second internal voltage and to control a drain-source voltage of the third transistor to be constant; and an eighth transistor connected in series to the fourth transistor and configured to control the second transistor in accordance with the second internal voltage and to control a drain-source voltage of the fourth transistor to be constant.

13. The power supply device according to claim 10, the voltage selection circuit comprising:

ninth and tenth transistors connected in series between the first terminal and the second output node;

eleventh and twelfth transistors connected in series between the second terminal and the second output node;

a thirteenth transistor configured to control the ninth and tenth transistors in accordance with the control signal; and a fourteenth transistor configured to control the eleventh and twelfth transistors, in accordance with the control signal, wherein each of the ninth, tenth, eleventh, and twelfth transistors includes a source and a back gate that are connected to each other, the ninth and tenth transistors are a same conductivity type and have one of drains mutually connected to each other or sources mutually connected to each other, and the eleventh and twelfth transistors are a same conductivity type and have one of drains mutually connected to each other or sources mutually connected to each other.

14. The power supply device according to claim 10, the voltage selection circuit comprising:

a seventeenth transistor connected in series with the first transistor between the first terminal and the second output node;

an eighteenth transistor configured to control the seventeenth transistor in accordance with the control signal;

a nineteenth transistor connected in series with the second transistor between the second terminal and the second output node; and a twentieth transistor configured to control the nineteenth transistor in accordance with the control signal, wherein the eighteenth transistor is configured to turn off the seventeenth transistor while the first transistor is in an OFF conductive state, and the twentieth transistor is configured to turn off the nineteenth transistor while the second transistor is in an OFF conductive state.

15. The power supply device according to claim 10, the voltage selection circuit comprising:

a twenty-first transistor connected in series with the first transistor between the first terminal and the second output node;

a twenty-second transistor connected in series with the twenty-first transistor and configured to control the first transistor in accordance with a level of the second internal voltage;

a twenty-third transistor connected in series with the twenty-second transistor and configured to control the twenty-first transistor in accordance with the control signal;

a twenty-fourth transistor connected in series with the second transistor between the second terminal and the second output node;

a twenty-fifth transistor connected in series with the twenty-fourth transistor and configured to control the second transistor in accordance with the level of the second internal voltage; and a twenty-sixth transistor connected in series with the twenty-fifth transistor and configured to controls the twenty-fourth transistor in accordance with the control signal, wherein the twenty-third transistor is configured to turn off the twenty-first transistor while the first transistor is in an OFF conductive state, and the twenty-sixth transistor is configured to turn off the twenty-fourth transistor while the second transistor is an OFF conductive state.

16. A voltage switching circuit, comprising:

a first terminal connectable to a DC voltage generation circuit;

a second terminal connectable to a rechargeable battery;

a first voltage generation circuit configured to generate a first internal voltage using at least one of a first terminal voltage from the first terminal and a second terminal voltage from the second terminal;

a first control circuit configured to generate a first control signal using the first internal voltage;

a voltage selection circuit configured to receive the first internal voltage and select between the first terminal voltage and the second terminal voltage according to the first control signal;

a regulator receiving the selected one of the first terminal voltage and the second terminal voltage and supplying a second internal voltage; and a switching element configured to switch an electrical connection between the first terminal and the second terminal according to an external control signal, wherein the voltage selection circuit comprises:

a first transistor of a first conductivity type and configured to switch a connection between the first terminal and an output node of the voltage selection circuit;

a second transistor of the first conductivity type and configured to switch a connection between the second terminal and the output node;

a third transistor of a second conductivity type and configured to control a conductive state of the first transistor; and a fourth transistor of the second conductivity type and configured to control a conductive state of the second transistor, wherein the third and fourth transistors are controlled by a control signal from the first control circuit.

* * * * *